US006082874A

United States Patent [19]

Huang

[11] Patent Number: 6,082,874

[45] Date of Patent: Jul. 4, 2000

[54] COUPLING DEVICE FOR CHRISTMAS LIGHT

[76] Inventor: Shun-Feng Huang, No. 56, Min Sheng Street, Feng-Yuan City 42041, Taiwan

[21] Appl. No.: 09/292,786

[22] Filed: Apr. 13, 1999

[51] Int. Cl.[7] ..... H01R 33/00

[52] U.S. Cl. ..... 362/226; 362/249

[58] Field of Search ..... 362/249, 252, 362/391, 396, 806, 226

[56] References Cited

U.S. PATENT DOCUMENTS 5,908,238 6/1999 Huang ..... 362/391
5,941,628 8/1999 Chang ..... 362/249

*Primary Examiner*—Stephen Husar

[57] ABSTRACT

A coupling device for Christmas light is provided, the coupling device includes a pair of rectangular recesses in the opposing inner peripheries of an electrical socket for respectively securing a pair of contact plates from a pair of electrical wires, a pair of lugs on opposing outer peripheries of the socket each having a cylindrical space and a slit entrance for receiving the wires and a first elongate notch extending along the length of the entrance, a pair of L-shaped extensions symmetrically projected outward from the upper rim of a bulb base each having a second elongate notch extending along the length of a downwardly extended longer portion for slidably engaging with the first elongate notches of the lug members. Thereby, the electrical wires are blocked up by the L-shaped extensions.

3 Claims, 6 Drawing Sheets

COUPLING DEVICE FOR CHRISTMAS LIGHT

BACKGROUND OF TIE INVENTION

The present invention relates to the Christmas lights and more particularly to a coupling device for Christmas light which device can firmly connect the bulb with the socket of the Christmas light and reliably attach the wires between the Christmas lights for arrangement of light patterns or alphabet in order to achieve a cosmetic effect.

Typical strung up Christmas light has a coupling device on outer periphery for the attachment of the wires between the light to make a network for presenting a light pattern or alphabet. One of my previous invention as shown in FIG. 1 comprises a socket 1, a pair of lugs 2 symmetrically projected outward from the opposing peripheries of the socket 1, a pair of electrical wires 3 extending out from the bottom of the socket 1. The is made of elastic material and each has slit 4 for facilitating the pressed in of the wires 3. A bulb 6 engaged with a base 5 which is eventually pressed in the socket 1.

However, the strung up Christmas light has the following disadvantages such that the electrical wires 3 may disengaged with lugs 2 and/or the bulb so as to cause an electric disconnection.

SUMMARY OF THE PRESENT INVENTION

The present invention has a main object to provide a coupling device for Christmas light which device is reliable so as to prevent the electrical wires from disengagement with the lugs on outer peripheries of the socket.

Another object of the present invention is to provide a coupling device in which a rectangular recess is formed in the opposing inner peripheral walls of the socket made engageable within a rectangular contact plate at the end of each of the electrical wires so that the electrical disconnection between the bulb and the wires will be eliminated which the wires are under external pullings.

The present invention will become more understood by reference to the following detailed description thereof when read in conjunction with the attached drawings.

DETAILED DESCRIPTION OF THE PREFERRED EMBODIMENT

Figure 1:
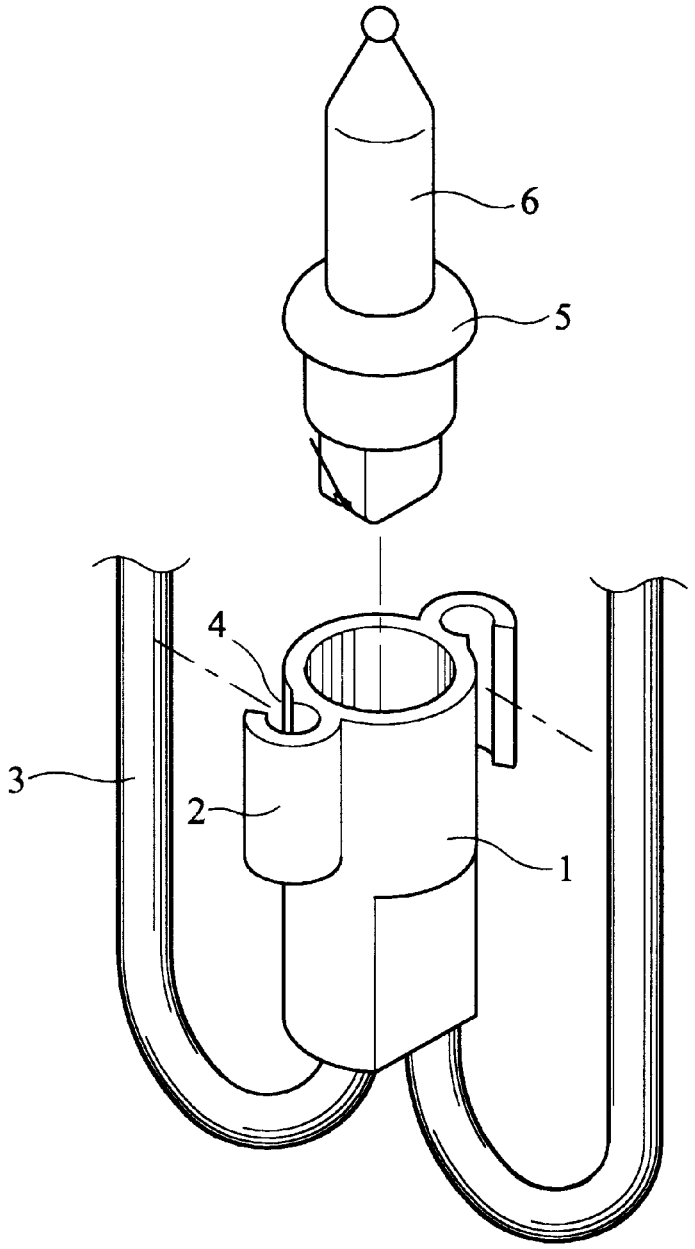
FIG. 1 Prior Art
FIG. 1 is an exploded perspective view of a strung up Christmas light of a prior art.
Figure 2:
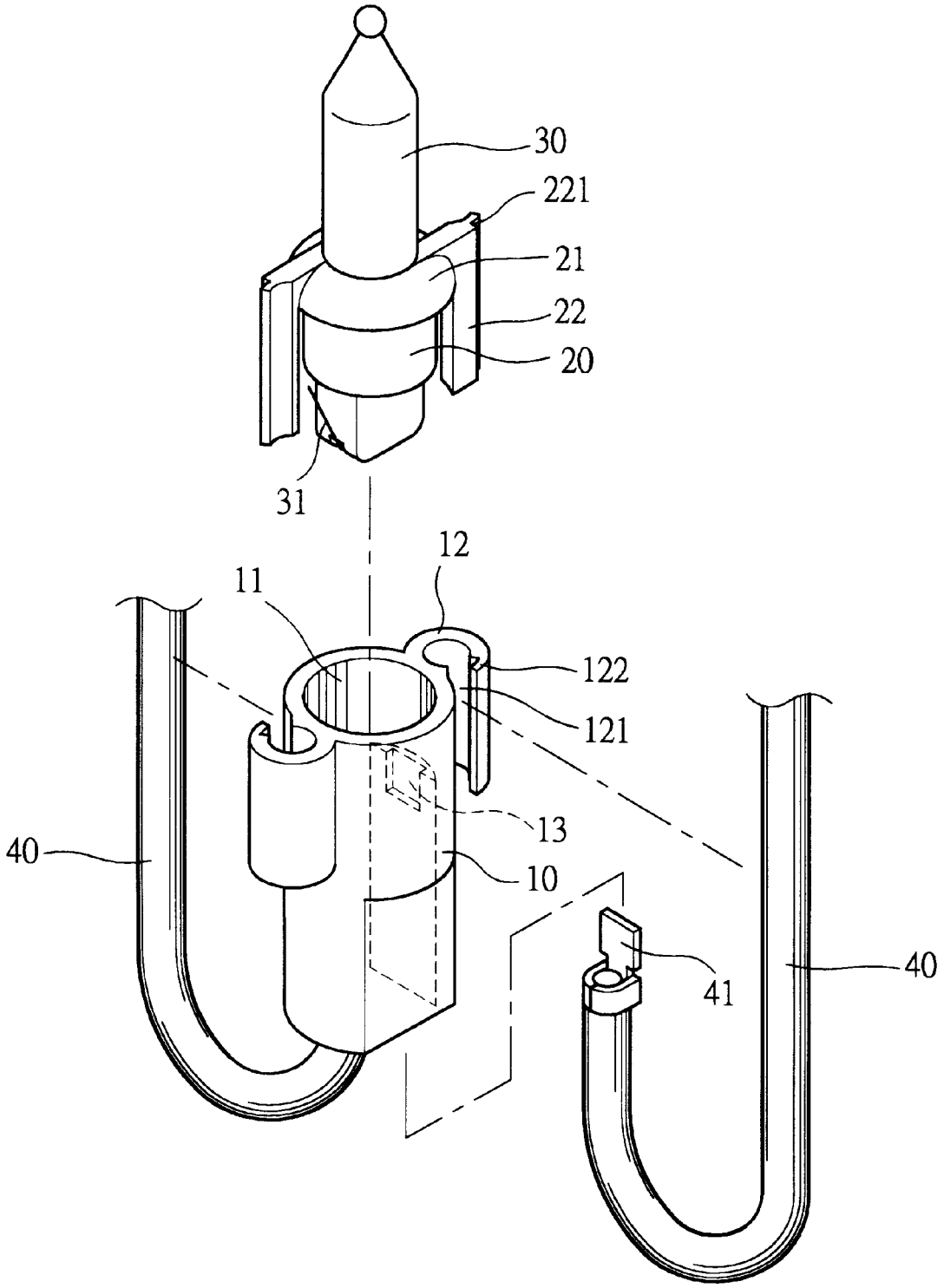
FIG. 2 is an exploded perspective view to show a preferred embodiment of the present invention.
Figure 3:
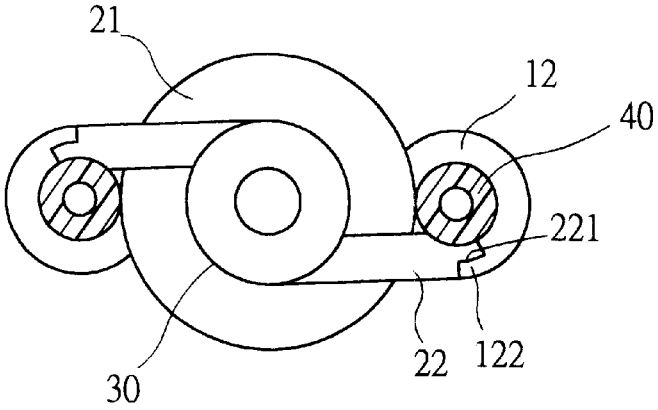
FIG. 3 is a sectional view of FIG. 2 while the electrical wires engage with the first lugs of the coupling device.
Figure 4:
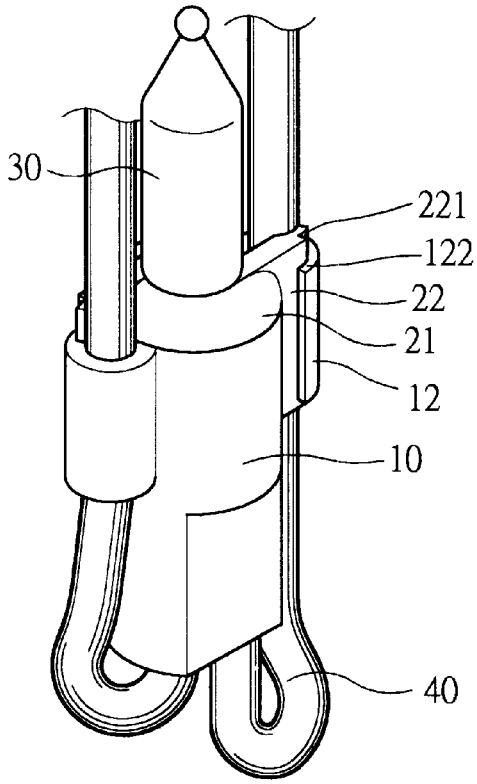
FIG. 4 is a perspective view of FIG. 3.

With reference to FIGS. 2 to 4 of the clawings, the coupling device for Christmas light of the present invention comprises generally an electrical socket 10, a base 20 into which a bulb is axially secured and a pair of lead-in wires 31 extending out of the bottom of the base 20 and attached to each of the lateral sides of the base 20. The socket 10 includes a pair of lugs 12 symmetrically extending outward from the opposing outer peripheries of the socket 10, an upper opening 11 and a pair of rectangular recesses 13 symmetrically formed in the opposing inner peripheral walls into each of which a rectangular contact plate 41 at an end of a pair of electrical wire 40 is secured. The lugs 12 are made of elastic arcuate plate and each has a slit entrance 121 for facilitating one of the wires 40 pressed into a cylindrical space defined by the plate and a first elongate notch 122 formed in an inner surface of the plate abutting the slit entrance and along the length of the lugs 12.

A pair of L-shaped extensions 22 symmetrically extending outward from the opposing rims 21 of the base 20 each of which includes a second elongate notch 221 formed on an outer surface of the downwardly extended longer portion of the L-shaped extension 22 along the length and engageable with the first elongate notch 122 of the lugs 12.

When assembling first engage the rectangular contact plates 41 of the pair of electrical wires into the rectangular recesses 13 of the socket 10 respectively and engage the wires 40 into the respective lugs 12 in a snap fitting and then axially press the base 20 in place into the socket 10 via the opening 11 so that the lead-in wires 31 are automatically engaged with the contact plate 41 and prevented the plate 41 from disengagement with the recesses 13. Meanwhile, the longer portions of the L-shaped extensions 22 slidably engage with the lugs 12 in the manner that the second elongate notches 221 engage with the first elongate notches 122 so that the slit entrances 121 are completely block up by the extensions 22 and the wires 40 will no longer be breakaway from the lugs 12.

Figure 5:
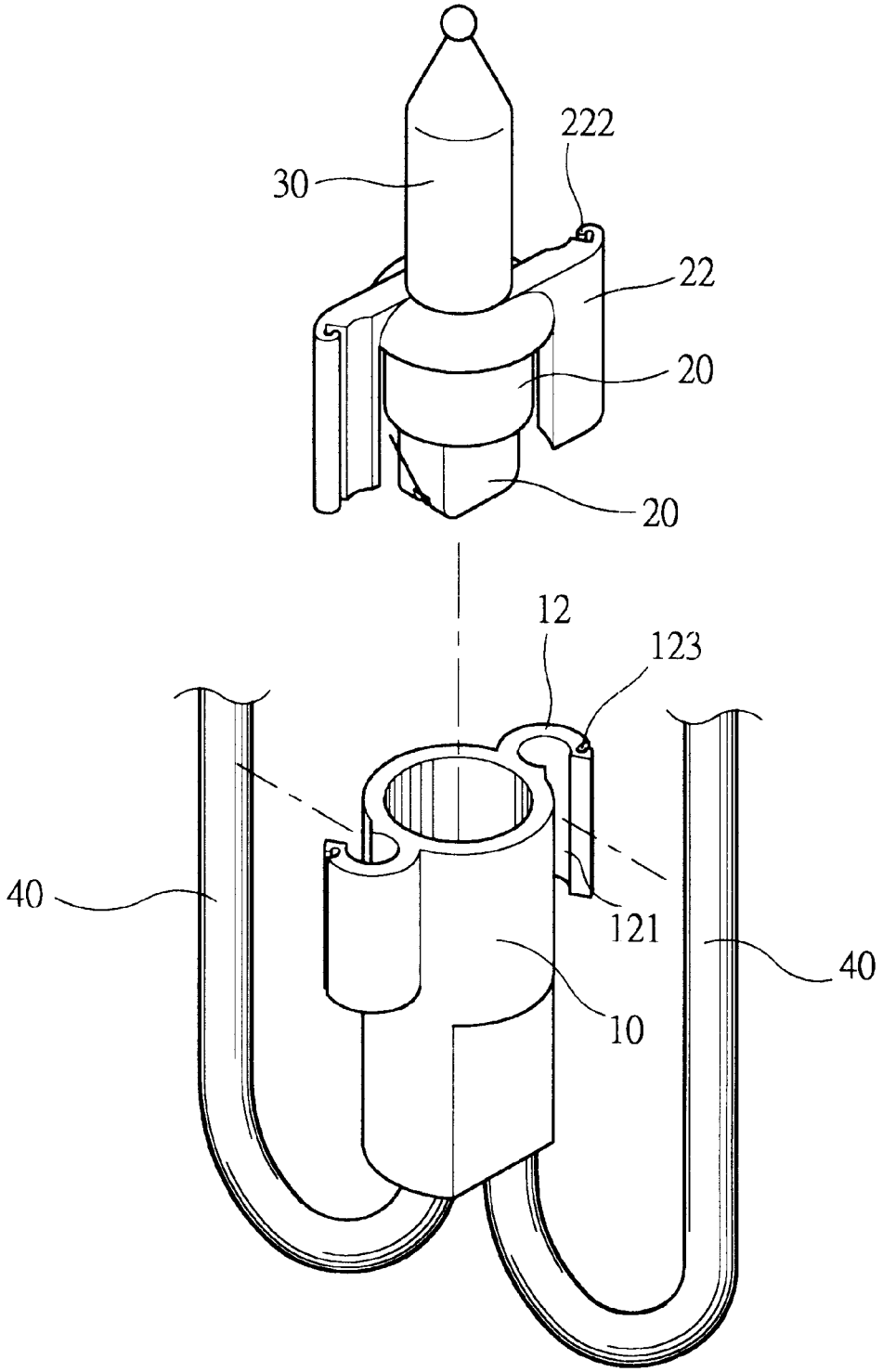
FIG. 5 is an exploded perspective view to show an alternative embodiment of the present invention.
Figure 6:
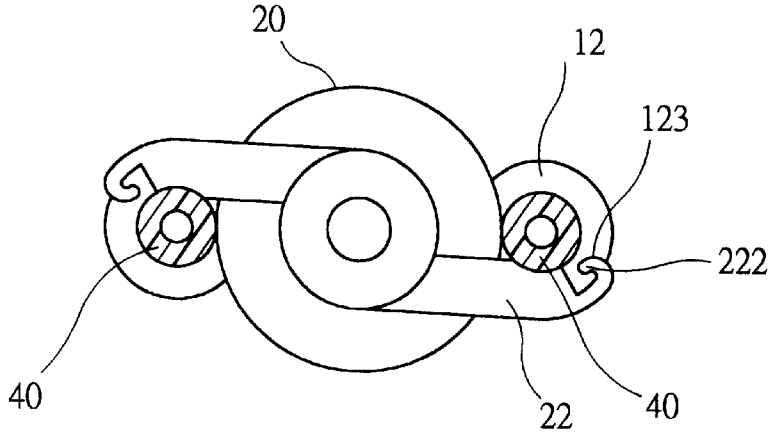
FIG. 6 is a sectional view of FIG. 5 while the electrical wires engage within the second lugs of the coupling device.
Figure 7:
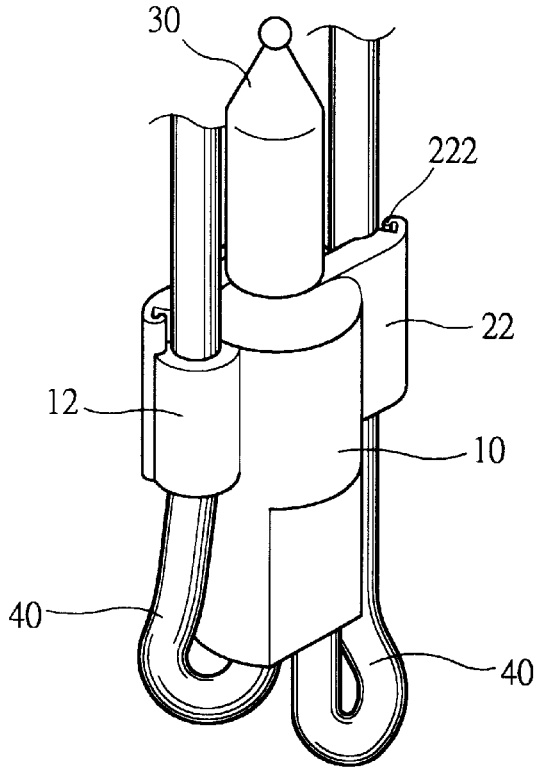
FIG. 7 is a perspective view of FIG. 6.

Referring to FIGS. 5 to 7, an alternative embodiment is provided in which the structure and function are mostly similar to the previous embodiment as shown in FIGS. 2 to 4, the above discussion are acceptable in the most instances. The only differences are that the first elongate notch 122 is omitted. Instead of is a third elongate notch 123 formed in an outer surface of each of the lugs 12 butting the slit entrance 121 of the lugs 12. Where, the second elongate notches 221 are also omitted. Instead of is a fourth notch 222 formed in an inner surface of the longer portion of each of the L-shaped extensions 22 and slidably engages with the third elongate notches 122. Upon this slight modification, the L-shaped extensions 22 can also block up the slit entrances of the lugs 12.

Figure 8:
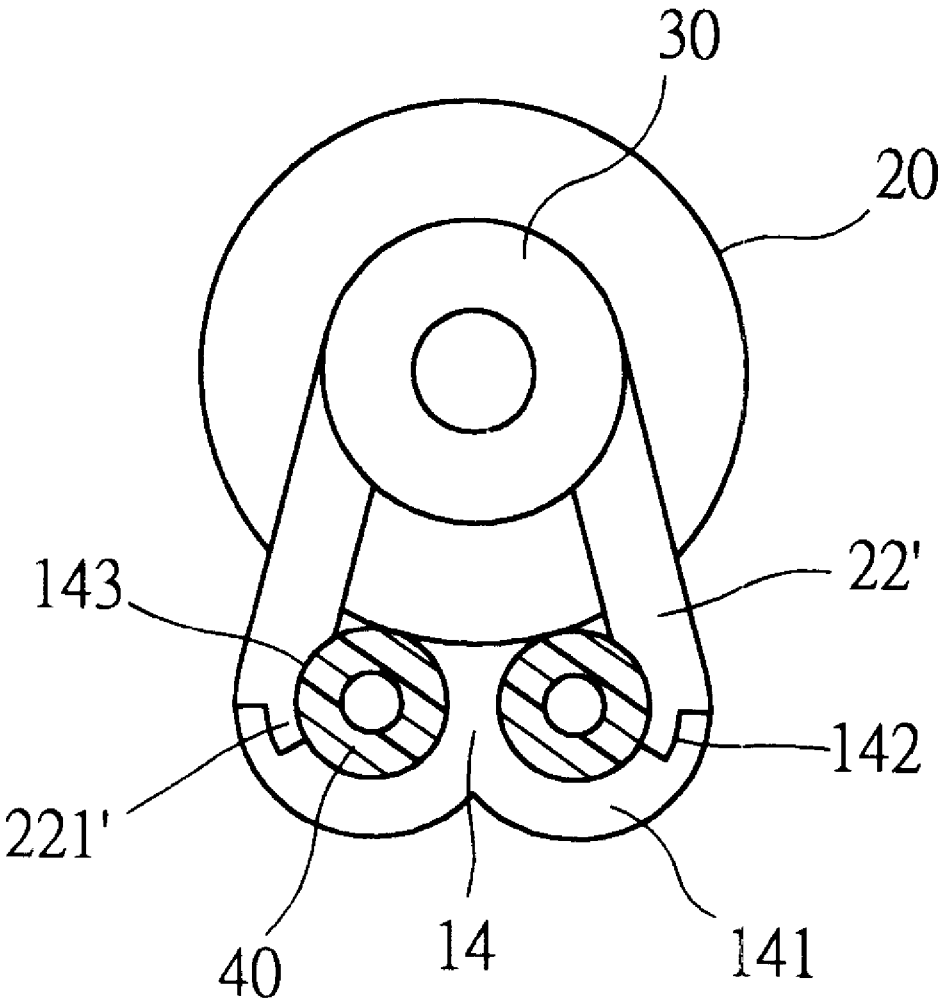
FIG. 8 is a sectional view to slow another alternative embodiment of the present invention.

Referring to FIG. 8 of a sectional view showing another alternative embodiment of the present invention in which the most structure and function are unchanged, too. The only modification is made to coupling device. In comparison with that shown in FIGS. 2 to 4, the pair of third elongate lugs 12 become a single projection 14 projected outward from an outer periphery of the electrical socket 10 including a pair of arcuate branches 141 extending laterally relative to the center of the projection 14 so as to define a pair of cylindrical spaces 143 for receiving the pair of electrical wires 40. The branches 141 each includes a fifth notch 142 in an inner surface abutting the free end of the branch 141. Whereas, the pair of the L-shaped extensions 22 are moved to same side of the base 20 and re-designated as 22'. Their elongate notches are also re-designated as 221'. Upon the changing of position, the extensions 22' can effectively block up the slit entrance of the cylindrical spaces 143 and their notches 221' can slidably engage with the notches 142.

Note that the specification relating to the above embodiments should be construed as exemplary rather than as limitative of the present invention, with many variations and modifications being readily attainable by a person of average skill in the art without departing from the spirit or scrape thereof as defined by the appended claims and their legal equivalents.

I claim:

1. A coupling device for Christmas light comprising:

an electrical socket including a first opening in top, a pair of rectangular recesses symmetrically formed in opposing inner peripheries for respectively securing in a pair of rectangular contact plates from a free end of each of a pair of electrical wires and a pair of lug members of arcuate elastic plate symmetrically extending outward from opposing outer peripheries thereof and each having a cylindrical receiving space for respectively receiving said pair of electrical wires, a slit entrance communicating with the receiving space and a first elongate notch in an inner surface abutting the slit entrance and along the length thereof;

a base including a second opening and a rim on top, a bottom, a bulb axially disposed into the second opening having a pair of lead-in wires extending out of the bottom and respectively attached to opposing lateral sides of the bottom and a pair of L-shaped extensions symmetrically extending outward from the rim each having a longer portion extending downward and engageable with the slit entrance of said lug members and a second elongate notch in an outer surface abutting free end along the length thereof and slidably engaging with the first elongate notch of said lug members;

when said base axially secures into the first opening of said electrical socket, said lead-in wires will contact with said rectangular contacts plate and the longer portions of said L-shaped extensions will block up the slit entrances of said lug members.

2. The coupling device as recited in claim 1 wherein said lug members each includes a third elongate notch in an outer periphery abutting said slit entrance extending along the length thereof.

3. The coupling device as recited in claim 1 wherein said L-shaped extensions each includes a fourth elongate notch in an inner side along the length of the longer portion thereof and slidably engageable with the third elongate notches of said lug members.

* * * * *